US005634539A

United States Patent [19]

Gordon

[11] Patent Number: 5,634,539

[45] Date of Patent: Jun. 3, 1997

[54] MEANS FOR AND METHODS OF MANUFACTURING A LUGGAGE FRAME

[76] Inventor: Bruce F. Gordon, 2134 Greystone, Hoffman Estates, Ill. 60195

[21] Appl. No.: 411,497

[22] Filed: Mar. 28, 1995

[51] Int. Cl.[6] ..... A45C 13/36

[52] U.S. Cl. ..... 190/24; 190/25; 220/642; 229/198.1; 229/198.3; 217/65

[58] Field of Search ..... 190/24, 25; 220/430, 220/642, 656, 684, 685; 229/198.1, 198.2, 198.3, 199; 217/12 R, 13, 65

[56] References Cited

U.S. PATENT DOCUMENTS

| | | | |
|---|---|---|---|
| 2,659,515 | 11/1953 | Miller | 220/684 |
| 2,993,637 | 7/1961 | Lacey | 229/198.1 |
| 3,223,309 | 12/1965 | Chiorri | 229/198.1 |
| 3,261,493 | 7/1966 | Smith | 220/684 X |
| 3,266,656 | 8/1966 | Kridle | 220/684 X |
| 5,377,857 | 1/1995 | Taravella et al. | 229/198.1 X |
| 5,538,178 | 7/1996 | Zink et al. | 229/198.1 X |

FOREIGN PATENT DOCUMENTS

| | | | |
|---|---|---|---|
| 90723 | 4/1959 | Netherlands | 190/25 |

OTHER PUBLICATIONS

"R & R Cases Worlds Toughest", brochure from R & R, 1217 Rand Road, DesPlaines, IL 60016, date of publication unknown.

*Primary Examiner*—Allan N. Shoap
*Assistant Examiner*—Christopher J. McDonald
*Attorney, Agent, or Firm*—Laff, Whitesel, Conte & Saret, Ltd.

[57] ABSTRACT

A box-like luggage item, such as a trunk, has panels forming ends, sides, top, and bottom of the box. Extruded strips having coves therein receive and grip edges of the panels in order to form the panels into the box-like structure. The box-like structure has a lid and a body with some of the extruded strips having a single cove for receiving a lower edge of each side of the lid and other extruded strips receiving an upper edge of each side of the body. Each of these extruded strips contains an area of a predetermined cross section for receiving an arm of an L-shaped bracket having the same predetermined section which strengthens and aligns the corner of the frame. This ability to align corners enables an elimination of a prior art practice of first installing a strip, cutting a notch in the strip, and then removing the notched material in order to mount hardware.

10 Claims, 8 Drawing Sheets

MEANS FOR AND METHODS OF MANUFACTURING A LUGGAGE FRAME

This invention relates to frames in general and more specifically to means for and methods of making the frames for luggage, trunks, cases, and the like.

A construction technique which is widely used to make luggage, trunks, suitcases, instrument cases, and the like ("luggage"), involves covering panels of plywood with an exterior coating, such as vinyl, enameled metal, or the like. Then, a suitable metal frame is built around the panels to assemble them into a completed structure having a general box-like appearance. The frame is generally cut to form notches in order to provide relief areas for mounting hardware, such as hinges, latches, and the like on the luggage.

As practiced in the past, this type of construction is expensive because it is labor intensive and wastes expensive material as compared to the costs of other material going into the construction of the luggage. This waste is a severe problem since the luggage made with this type of construction is sold in a highly competitive market. Therefore, any reduction of labor content or waste of material used to make the luggage is a step forward.

Usually, the modern frames are made from strips of extruded aluminum or similar material which are cut to specific lengths that fit against and receive the edges of the panels. The cross section of the extruded strips are generally U-shaped and include a cove or recess which fits over and grips the edges of the panels. Clamps are applied to bring the extruded strips into a rectangular configuration (or any other desired configuration) with a tight fit against the edge of the panels and thereby form a frame for the panels. Then, notches are cut into the extruded strips to provide relief areas for receiving and mounting hardware items (latches, hinges, etc.). The material which is so cut out of the extruded strips is discarded, thereby wasting the cut-out section of the extruded strip, which is usually the most expensive single item on the luggage.

This simplified description of conventional luggage construction illustrates, by way of example, a waste of labor in clamping, cutting, and discarding and the waste of material which is discarded. These practices, which have been used in the past, often lead to other problems, such as either inadequate or expensive quality control.

Accordingly, an object of the invention is to provide new and novel means for and methods of constructing frames for the described type of luggage. In particular, an object is to eliminate the need for the time consuming and labor intensive clamping.

Another object is to eliminate the need for cutting the frame to install hardware, and thereby to save the labor of cutting and the waste of the cut out material. Here an object is to improve the quality and reduce the cost of quality control for making luggage.

In keeping with an aspect of the invention, these and other objects are accomplished by providing an extruded frame having an internal shape for receiving a corner bracket which automatically aligns and strengthens the junction between two extruded metal strips forming the frame. With such a bracket, a simple, easy to apply corner clamp may be used to eliminate the massive amount of clamping used heretofore. The extruded frame is pre-cut to size before it is applied to the panel in order to eliminate the notching cut required heretofore, and thereby save the cost of material destroyed by the notching process. This pre-cut is made possible by the corner bracket which insures a proper alignment of even very short frame pieces.

A preferred embodiment of the invention is shown in the attached drawings, in which.

Figure 5A:
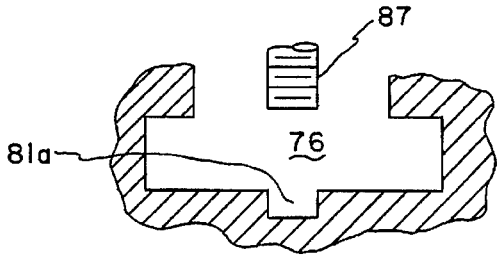
FIG. 5 shows the cross section of a male extruded frame member, such as might be used on the lower edge of a trunk lid, for example.
Figure 5:
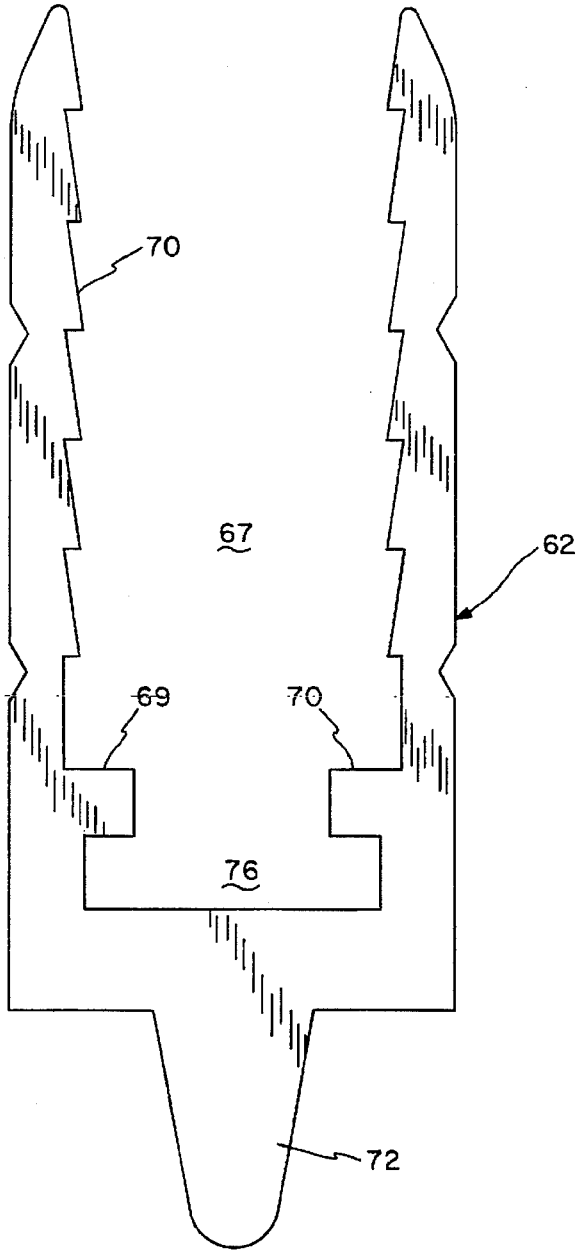
Figure 6:
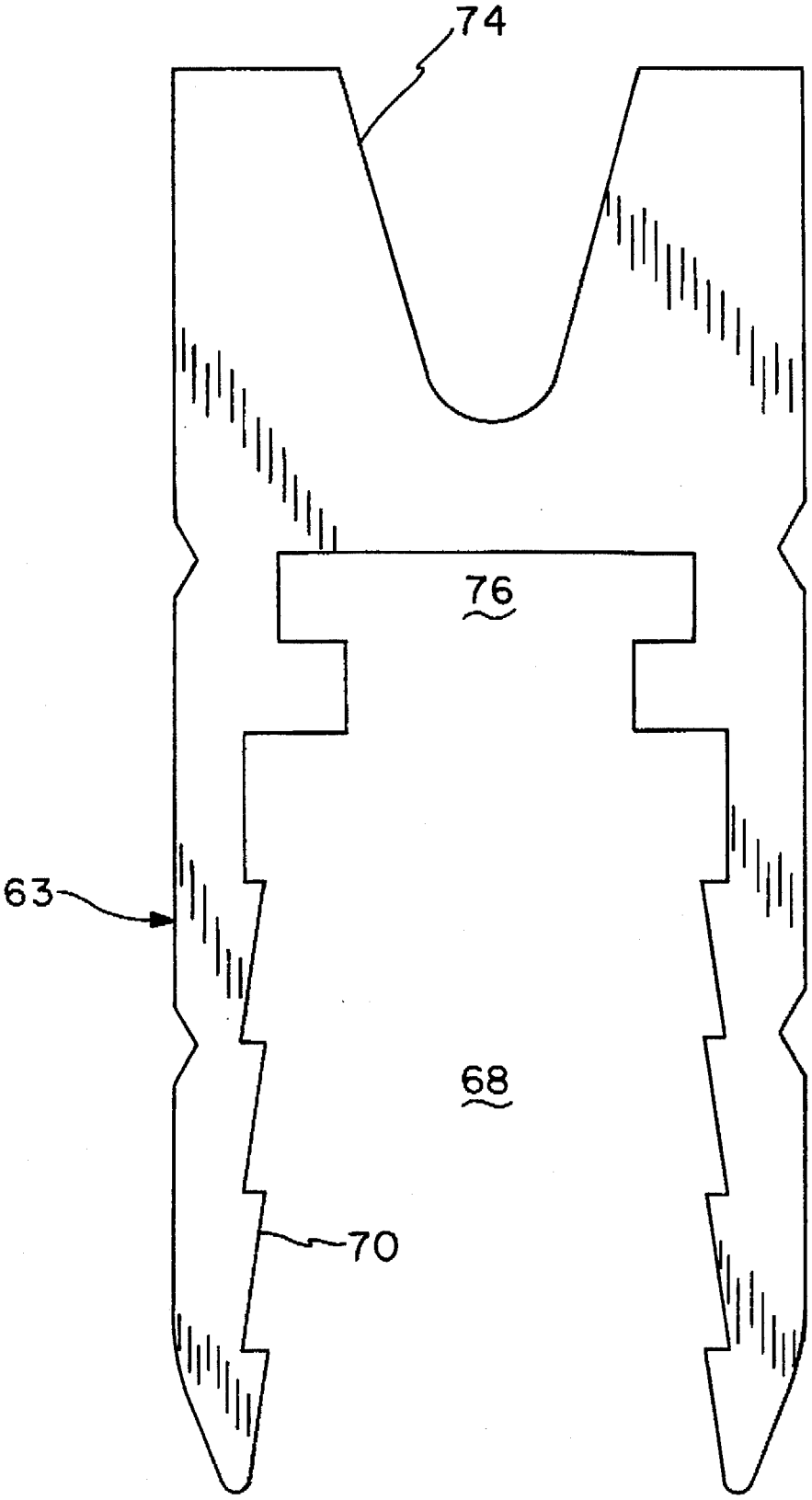
Figure 7:
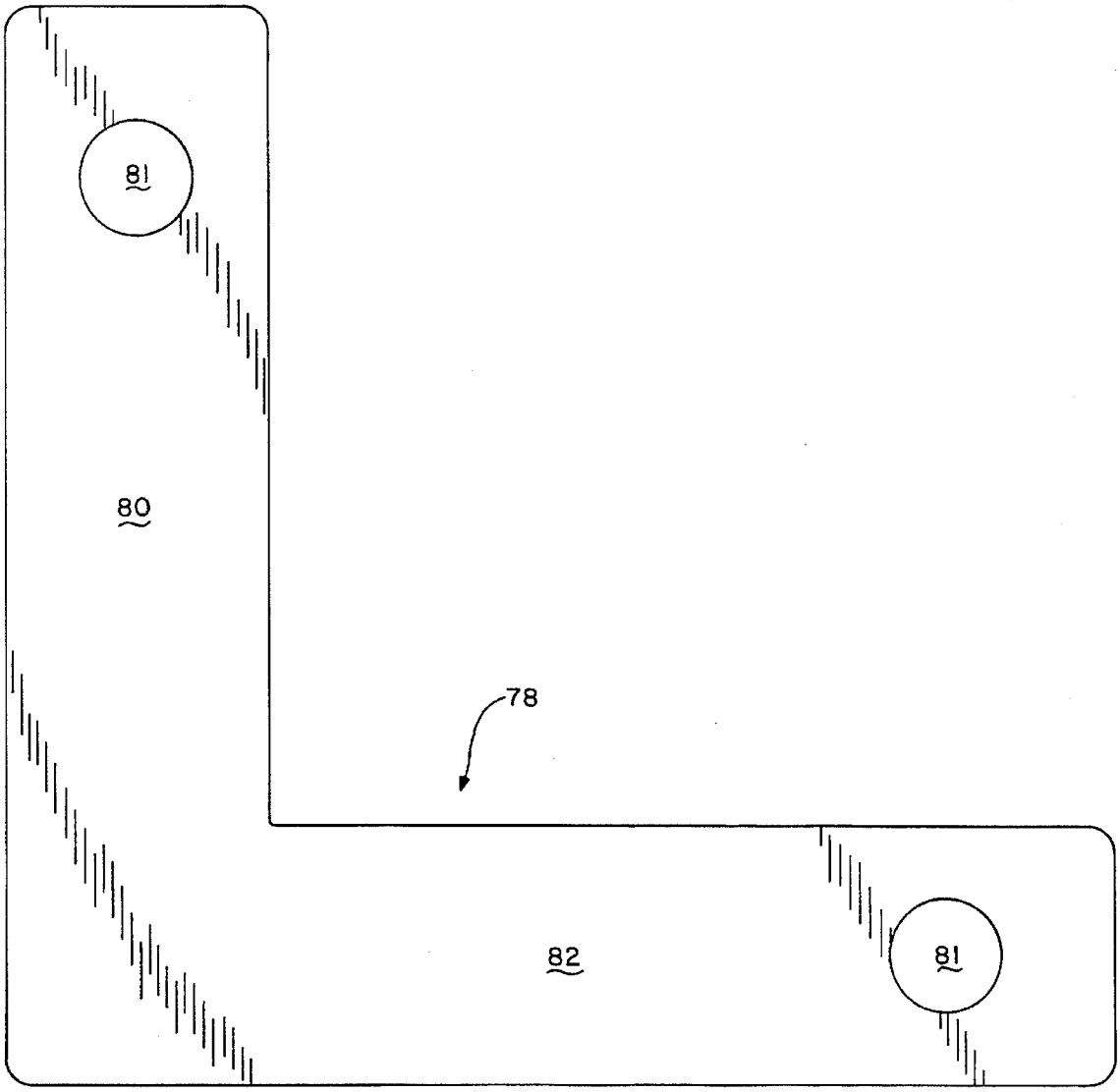
Figure 7A:
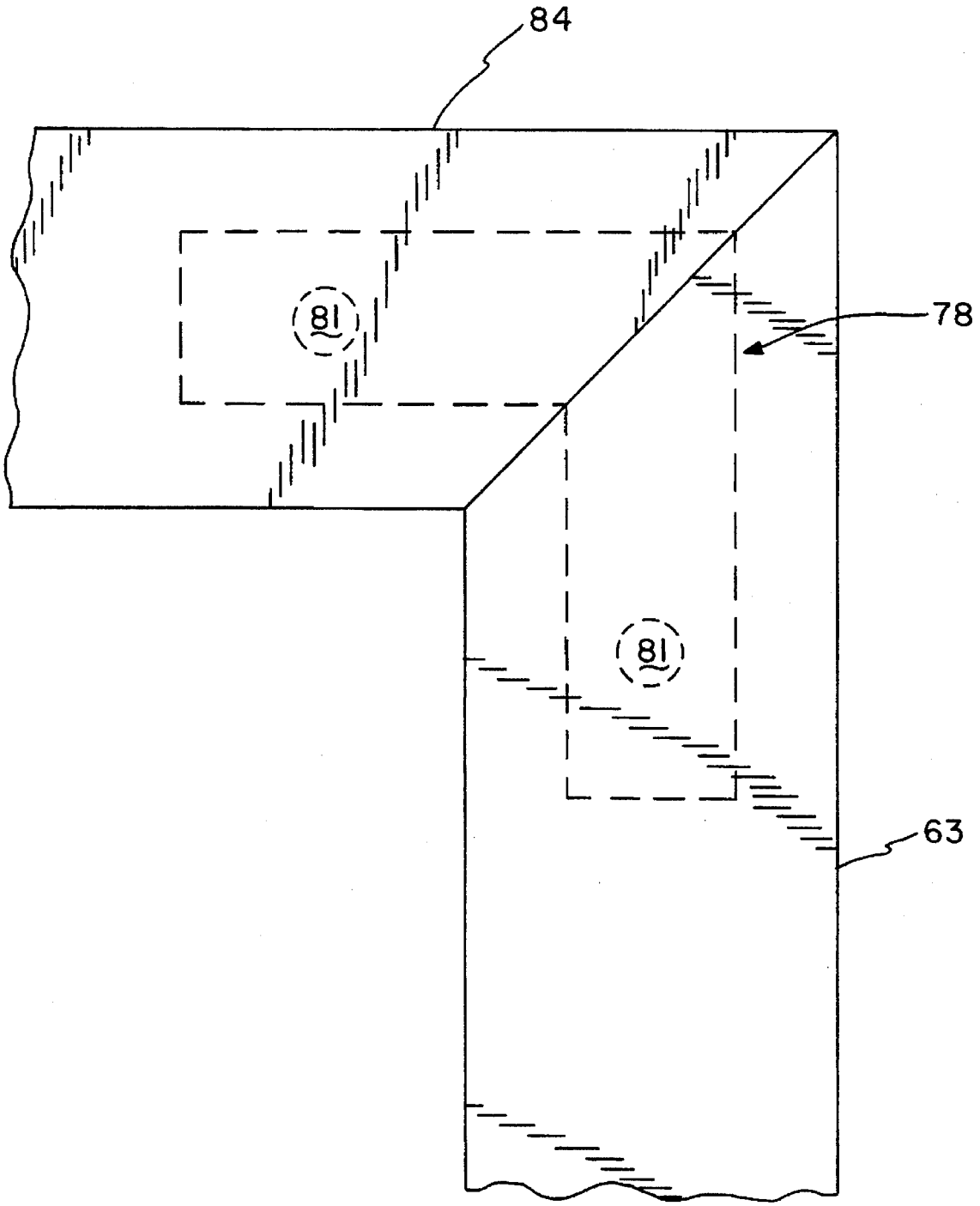
Figure 8:
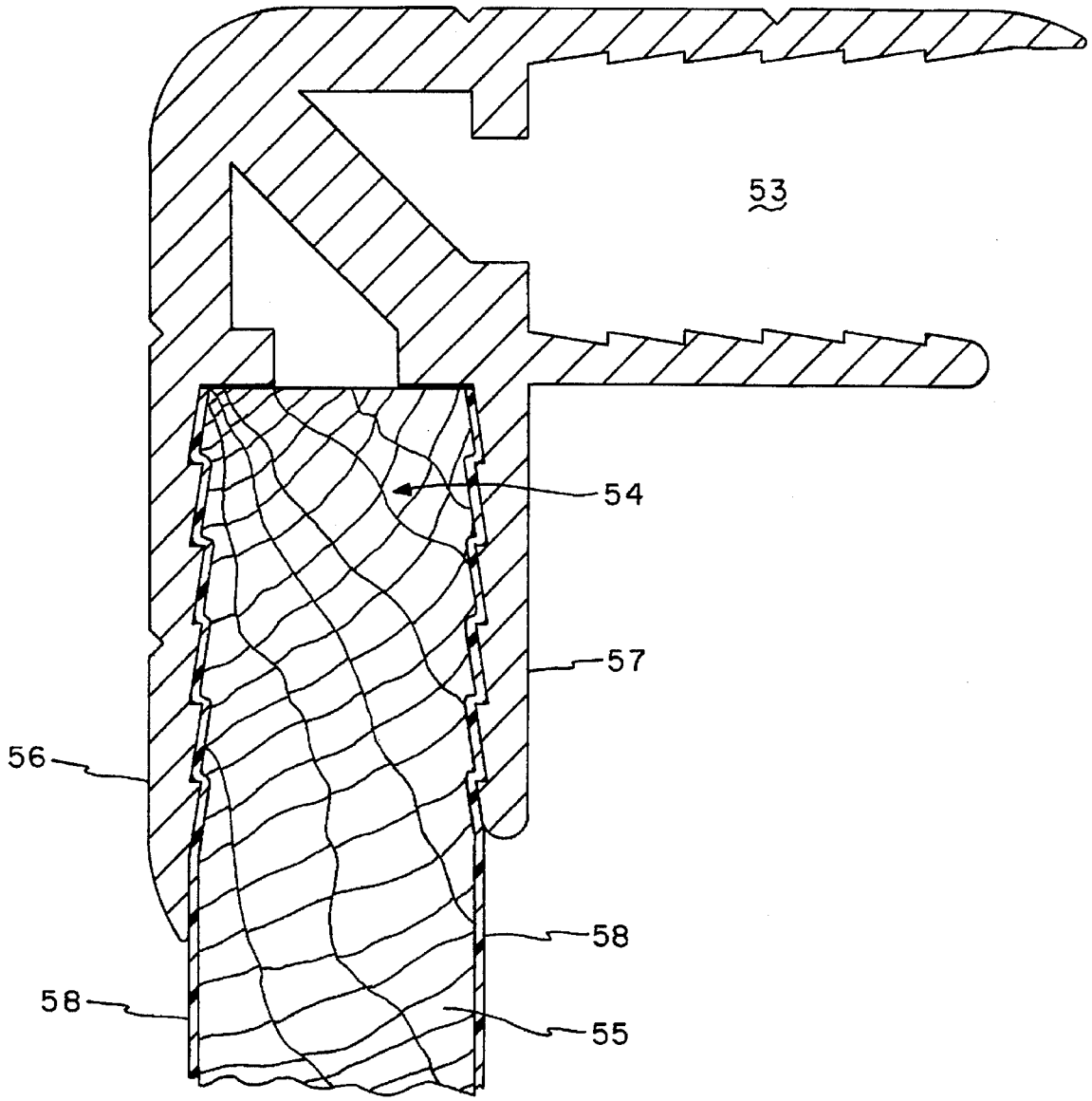
FIG. 8 (PRIOR ART)
Figure 9:
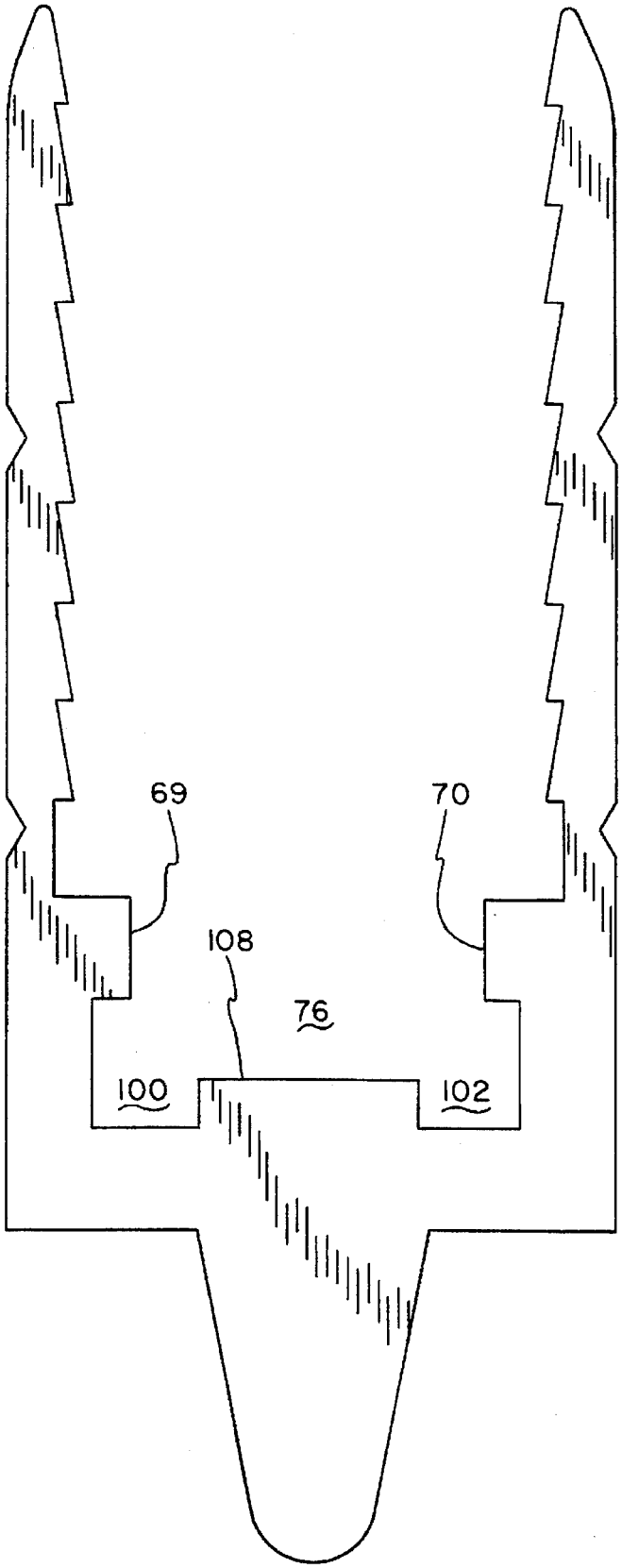
Figure 10:
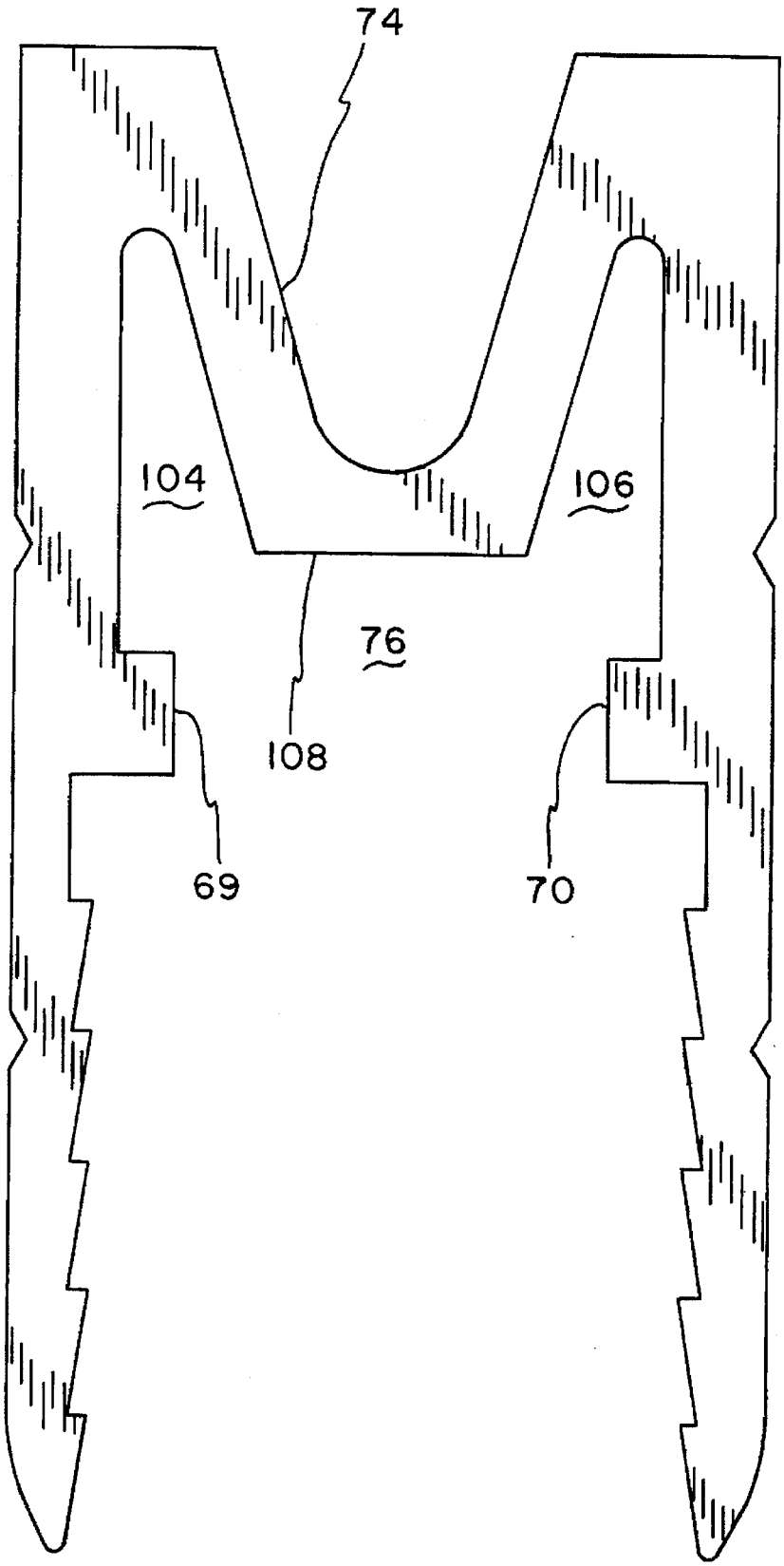

FIG. 5*a* shows an alternative extrusion with a slot for receiving a screw, especially one with a self cutting thread;

FIG. 6 is a similar cross section showing the female frame member which might be used as a frame on the upper edge of the trunk body proper;

FIG. 7 shows a corner bracket which is used with the frame extrusions of FIGS. 5 and 6;

FIG. 7*a* is a stylized plan view of two extruded strips in place at a mitered corner with the corner bracket of FIG. 7 locked in place within the extruded strips;

FIG. 8 is a cross section which shows the extruded corner frame member which is the same extrusion that has been used in the prior art; and FIGS. 9 and 10 are cross sections of extruded strips which are used when the panels of the box are thicker.

Figure 1:
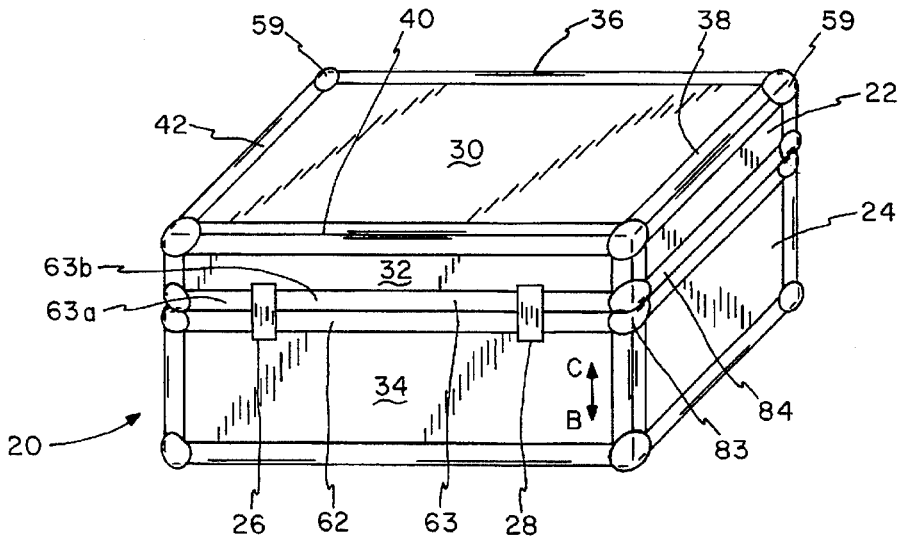
FIG. 1 is a perspective view of luggage in the form of a trunk, which is representative of almost any box-like structure which may be constructed according to the teachings of the invention.

FIG. 1 shows a trunk which represents any suitable box or luggage device 20 that may use the invention. Here, trunk 20 has a lid 22. On the back, the lid is hinged to the body 24. On the front of the trunk, any suitable clasps 26, 28 close to lock the top to the body or open to enable the lid to be raised. These clasps may be any known and suitable devices such as twist locks, hasps, etc. The side panels of the trunk, such as 30, 32, 34, may be made of plywood or particle board covered with a suitable material, such as vinyl, enameled metal, or the like.

Figure 2:
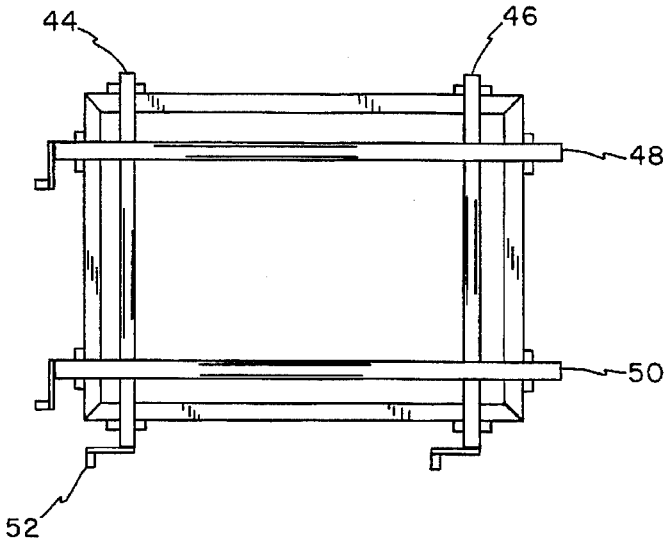
FIG. 2 is a plan view of the top of the FIG. 1 structure, which shows the type of clamping that has been required heretofore in order to construct a trunk.

To construct the luggage of FIG. 1, the common practice is to cut extruded strips of metal (such as 36–42) to form a frame around the periphery of each panel. Each extruded strip which forms part of the frame has a cove or recess which fits over and embraces a corresponding edge of a panel. Then, four clamps 44–50 (FIG. 2) are placed across the frame and drawn up to pull the extruded strips into the desired configuration and tightly against the panel. The process is repeated for each set of panels forming the luggage. While FIG. 2 shows manual clamps which are tightened by a hand operated crank, as at 52, any other suitable clamps may also be used.

The prior art extruded metal strips (FIG. 8) forming the frame members at each corner edge (such as 40) of the trunk has a pair of coves or recesses 53, 54 which stand at right angles to each other so that when the edges of the panels are forced into place within the cove, a box-like structure is formed. FIG. 8 has been drawn to show, by way of example, one wooden panel 55 in the embrace of arms 56, 57 which define cove 54 of the corner strip. Layers 58, 58 may be vinyl covers.

Once the box of FIG. 1 is formed, suitable corner caps (such as 59) are fastened to and across each junction between two of the extruded strips forming the frame members, thereby unifying the strips of metal into a strong frame.

After the box is completed, the frame is notched or cut away to provide relief areas for the attachment of hardware. For example, the strips 62, 63 (FIG. 1) are sawed or otherwise cut or notched in order to enable the clasps 26, 28 to be attached to the panels 32, 34. On the back of the luggage 20, similar cuts may be provided to receive the hinges. Of course, any other or specialized hardware may be installed in the same manner.

The usual way of making cuts or notches in frames for luggage, such as those described herein, is with a saber saw which cuts the strips 62, 63 as, for example, along lines 64, 65 (FIG. 3), the cuts being made after the strip has been installed on the panel. Then, the cut out material 66 must be removed from the panel 32 without damaging it. This install, cut, and removal procedure presents three problems. First, it is difficult to make a perfect cut with a saber saw which may be inclined off perpendicular or which may not follow a straight path. Second, the side walls forming the cove or recess in the extruded strip 62 may score or damage the covering 58 for the panel as it is first pulled into the embrace of the strip and then as the notch part of the strip is pulled off the panel.

The description of the prior art has thus far demonstrated wasted labor in the use of clamps 44–50 and in the cutting and removal of the notched out material. The notched out material 66 wastes (perhaps 8–10 inches, per extruded strip, for one luggage device) the most expensive material in the luggage. If the hinges are set in similar notches, the total wasted material (hinges and clasps) might be in the order of 32–40 inches per luggage item. The quality of the luggage is not as good as it could be because the cut lines 64, 65 are almost never made with the kind of precision which is possible with a miter box.

In keeping with an aspect of the invention, these and similar problems are eliminated in a simple and low cost manner. The cross sections of the inventive extruded metal strips 62, 63 are shown in FIGS. 5, 6 respectively. The same principle of corner construction may also be applied to the corner strips (FIG. 8), such as 36–40, for example, if there should be a need to notch them. However, the corner strips inherently form fairly strong structures and well aligned frame members since the panels set perpendicularly to each other (as panel 30 lies at a right angle to panel 32, for example). Therefore, the invention is usable with, but not as critical to the edge pieces.

On the other hand, the extruded strips 62, 63 are secured around open edges of the lid and body of the luggage which are not supported by any panel lying perpendicular thereto. Hence, inherently, the open frame formed by extruded strips 62, 63 is not as strong as the frames formed by the corner strips.

Each of the extruded strips 62 (FIG. 5) and 63 (FIG. 6) includes a cove or recess 67, 68 which receives the corresponding edge of a panel, including its covering material (similar to the showing in FIG. 8). Thus, for example, panel 32 (FIG. 1) is pressed into the cove or recess 67, up to the shoulders 69, 70. Somewhat ratchet-like teeth (one of which is numbered 70) line the cove or recess 62 so that it easily receives and grips the panel edge when installed, thereby tightly holding it to resist any effort to pull the extruded strip off the panel. The preferred profile for tooth 70 projects into the cove or recess by a distance of about 1/64-inch. The extruded strip 63 (FIG. 6) is made in a similar manner.

The strip 62 (FIG. 5) includes a projecting member 72 which fits into a complementary area 74 on strip 63 (FIG. 6) in order to form a dust proof seal between the lid 22 (FIG. 1), when closed, and the body 24 of trunk 20. Normally, projecting member 72 is on the lid since the two side edges of area 74 make a stronger surface if objects are laid on them. However, sometimes the complementary area 74 is used in an environment where it would collect debris, in which case it is placed on the lid and the projection 72 is on the body.

Both of the extruded strips 62, 63 contain an area 76 having a rectangular cross section which is outlined by heavily inked lines for easy identification. The cross sectional dimensions of the area 76 are substantially the same as the cross sectional dimensions of an L-shaped bracket 78 (FIG. 7). Therefore, if arm 80 is pressed into recess 76 in strip 63 and if arm 82 is pressed into recess 76 in extruded strip 84 (FIG. 1), the corner 83 at the top of trunk body 24 is unified and aligned in a quality manner.

Figure 4:
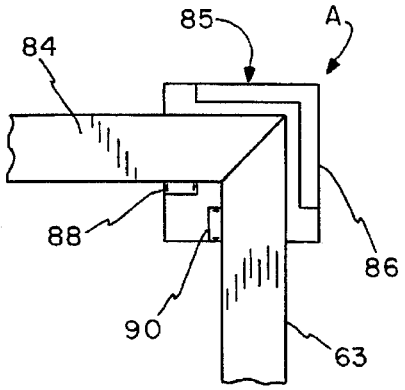
FIG. 4 is a plan view which shows a simple corner clamp which may be used by the invention in lieu of the clamps of FIG. 2.

FIG. 4 is a plan view which shows a corner clamp 85 that may be fitted over the corner formed by extruded strips 63, 84 and then tightened in direction A, thereby driving a movable right angle fence 86 into the corner and forcing the strips 84, 63 against stops 88, 90 and further forcing the L-shaped bracket 78 into the areas 76, 76. FIG. 7*a* shows the strips 63, 84 in their final position with the L-shaped bracket in its locking position within the arms 76, 76. It is quick and simple to use the clamp 85, as compared to the time consumed in applying the four clamps 44–50 of FIG. 2. Also, the old method of FIG. 2 required extra efforts to vertically align the mitered edges of the strips 63, 84 (directions B, C, FIG. 1). The new method using the L-shaped bracket automatically makes the vertical alignment.

Each arm of the L-shaped bracket 78 (FIG. 7) contains a threaded screw hole 81. After the L-shaped bracket is forced into a final position (FIG. 7*a*) within the properly aligned, extruded strips screws are driven through these holes 81, the access for a tool to tighten the screws being via the space between tabs 69, 70 (FIG. 5). The screw bottoms in the area 76 and locks the frame in its final position. In the embodiment of FIG. 5*a*, the extrusion includes a slot 81*a* in the area 76 under the screw 87. If the screw 87 is one which cuts its own threads, the slot 81*a* is effectively formed into a threaded nut.

In order to provide for mounting hardware while eliminating the need for cutting or notching the extruded strips and the waste material inherent thereto, the ends of the strips, such as 63*a* (FIGS. 1, 3), are cut in a miter box to a uniform and fixed length. Since a miter box is used, the cut ends are square and accurate to make a perfect fit with the clasps 26, 28. The center section 63*b* is cut to order, depending upon the overall length of the luggage. Thus, for example, if the FIG. 1 trunk is a foot locker, say four feet long, and if another box is four and a half feet long, for example, one strip 63*b* will be six inches longer than the other strip 63*b*, but the outside strips 63*a* will be the same length for both boxes.

Figure 3:
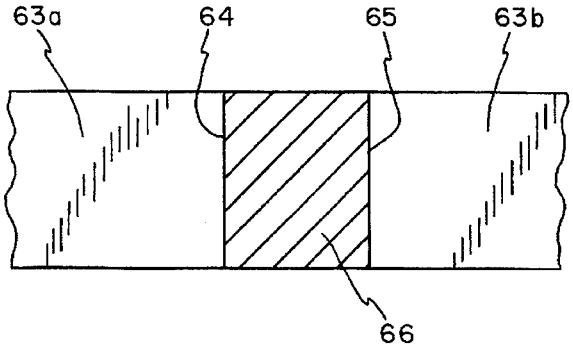
FIG. 3 illustrates how the frame is notched in order to provide a relief area which receives hardware on the luggage.

The advantage is that, with the inventive L-shaped corner piece 78 and areas 76, 76, it is possible to accurately align even the shortest piece, such as 63*a*. Under the old system, it was impossible to simply cut the extruded strip into parts 63*a*, 63*b*, for example, because there was no easy and practical way of aligning such short pieces. Hence, the invention (a) eliminates the labor represented by the excessive amount of clamping (FIG. 2) required by the old system, (b) enables a stronger corner, (c) aligns short corner pieces and thus eliminates waste when expensive extruded material is eliminated to mount hardware, and (d) improves quality by making a more perfect corner and by making a truer cut along edges 64, 65 (FIG. 3).

The extruded strips of FIGS. 5 and 6 are generally used with relatively thin panels, such as quarter inch plywood. Sometimes the equipment to be carried in the luggage is too heavy for such thin panels. Then the panels are made of thicker wood, such as three eights or half inch plywood. When the panels become thicker, the extruded strips become more massive, more aluminum or other material is required, and the cost increases substantially.

FIGS. 9 and 10 illustrate a technique that is used to reduce the amount of aluminum that is required to make the extrusion. Since the extrusions of FIGS. 9, 10 are for thicker panels, they are more massive so that some material may be eliminated without in any way reducing the strength to less than an adequate amount.

In FIG. 9, the extrusion deletes material in the areas 100, 102, which are outlined in heavily inked lines for easy identification. In FIG. 10, the contour of complementary area 74 is such that the areas 104, 106 of deleted material follow the exterior contour of the extruded strip.

In each case, the contours of the deleted material retains tabs 69, 70 which define the area 76 for receiving an arm of the L-shaped bracket and which stops the advance of the panel into the cove or recess. Also, the central area 108 which the locking screw engages is retained. The notch 85 (FIG. 5*a*) may be formed in the area 108 to receive a screen with a thread cutting capability.

Those who are skilled in the art will readily perceive how to modify the invention. Therefore, the appended claims are to be construed to cover all equivalent structures which fall within the true scope and spirit of the invention.

The claimed invention is:

1. A box-like structure formed of a plurality of panels fitted to and fastened by edge pieces which form the panels into a box, said box having at least an open part formed by panel edges surrounded by a frame, an L-shaped bracket having two arms, said frame being made of extruded strips which have a cove that fits over and embraces said panel edges, said extruded strips having an open area with a cross section which is sized and dimensioned to receive an arm of said L-shaped bracket which has substantially the same cross section, said L-shaped bracket aligning adjoining ones of said extruded strips when said bracket is forced into said open areas of said adjoining extruded strips.

2. The structure of claim 1 wherein said extruded strip comprises said cove having a generally U-shape for receiving and snugly embracing said panel edge, said open area being a rectangular area at a root end of said U-shape and in communication with said cove.

3. The structure of claim 2 and areas where metal is deleted in corners of said rectangular area, said deleted material retaining tabs for receiving one side of said arm and a central area for receiving a locking screw.

4. The structure of claim 2 and means associated with each of said arms for locking said arm to said adjoining one of said extruded strips in order to hold said strips in said alignment.

5. The structure of claim 4 wherein said locking means comprises at least one threaded hole in each of said arms and screws in said threaded holes which may be tightened against a part of said extruded strip which forms said open area.

6. The structure of claim 5 and a groove formed in said extruded strip at a location which is engaged by said screw, said screw being a thread cutting screw which cuts a thread into side walls of said groove.

7. A luggage device comprising a box having a lower section forming an open body, and a lid hinged to said lower section, said box being formed by wooden panels clad in a wear resistant cover material, a first strip having two members for receiving and holding adjacent ones of said panels at each corner edge of said box which forms said panels into said box, second strips along a top edge of said open body and a bottom edge of said lid, said second strips having one member for receiving and holding an edge on the lid or body panels, an L-shaped bracket having arms with a cross section of a predetermined shape, said second strip having a predetermined shape which snugly receives and holds an arm of said L-shaped bracket, whereby said L-shaped bracket aligns and holds said second strips which meet at the corners of said edges on said lid and open body so that said second strips form a frame around said lid and said body, and means for locking said L-shaped bracket to said second strips which meet at said corner.

8. The luggage device of claim 7 wherein at least one of said second strips which fit along at least one edge of said lid or bottom comprises at least two separate strips which are pre-cut and then attached to said at least one edge with a relief space between pre-cut ends of said at least two separate strips, and hardware fitted into said relief space and attached the panel receiving said two strips.

9. The luggage device of claim 8 wherein there are two of said relief spaces, and a clasp is mounted on the panel in each of said relief spaces.

10. The luggage device of claim 8 and a corner cap attached to and covering each junction where said strips meet at a corner of said box.

* * * * *